United States Patent [19]

Hansen et al.

[11] Patent Number: 4,462,790

[45] Date of Patent: Jul. 31, 1984

[54] ELECTRODE ARRANGEMENT FOR AN OIL OR GAS BURNER

[75] Inventors: Borge B. Hansen, Augustenborg; Ove S. Boe, Sonderborg, both of Denmark

[73] Assignee: Danfoss A/S, Nordborg, Denmark

[21] Appl. No.: 436,288

[22] Filed: Oct. 25, 1982

[30] Foreign Application Priority Data

Nov. 2, 1981 [DE] Fed. Rep. of Germany ..... 3143432

[51] Int. Cl.[3] ..... F23Q 3/00

[52] U.S. Cl. ..... 431/264

[58] Field of Search ..... 431/258, 264, 343; 248/57, 58; 403/165, 188, 252; 174/151, 161 R, 152 A; 403/209, 213, 353; 16/D36

[56] References Cited

U.S. PATENT DOCUMENTS

| | | | |
|---|---|---|---|
| 1,818,748 | 8/1931 | Pascoe | 431/264 |
| 1,830,326 | 11/1931 | Macrae | 431/264 |
| 2,011,872 | 8/1935 | Rava | 431/264 |
| 2,204,450 | 6/1940 | Schoenwetter | 431/264 |
| 2,500,787 | 3/1950 | Helgemann | 431/264 |
| 2,697,862 | 12/1954 | Flora | 248/56 |
| 3,182,329 | 5/1965 | Biesecker | 174/152 A |
| 3,241,144 | 3/1966 | Berger | 174/152 A |
| 3,490,856 | 1/1970 | Temple | 431/264 |
| 4,181,492 | 1/1980 | Zinke | 431/264 |
| 4,337,029 | 6/1982 | McElroy et al. | 431/264 |

FOREIGN PATENT DOCUMENTS

| | | | |
|---|---|---|---|
| 348965 | 2/1922 | Fed. Rep. of Germany | 174/161 R |
| 108660 | 4/1924 | Switzerland | 431/258 |
| 1190924 | 5/1970 | United Kingdom | 431/264 |
| 2083187 | 3/1982 | United Kingdom | 431/258 |

*Primary Examiner*—Carroll B. Dority, Jr.
*Assistant Examiner*—Helen A. Odar
*Attorney, Agent, or Firm*—Wayne B. Easton

[57] ABSTRACT

The invention relates to an electrode arrangement mounted in a support plate having a hole. An electrode rod holder with a spherical portion having a diameter larger than the hole is mounted in the hole. A spring coil attached to the support plate presses the spherical portion into the hold of the support plate. An electrode rod extends through a central bore of the holder. A spring damps the holder to the electrode rod.

6 Claims, 5 Drawing Figures

ELECTRODE ARRANGEMENT FOR AN OIL OR GAS BURNER

The invention relates to an electrode arrangement for an oil or gas burner, in which a rod electrode is carried by a holder held in a supporting plate which is fixed with respect to the housing.

In a known electrode arrangement (DE-AS No. 26 24 649), an ignition electrode comprises a thin wire which is bent towards the burner axis at the front and which is fixed in an insulating holder. This holder is fixed in a dividing wall serving as a supporting plate. The dividing wall separates two chambers containing different air paths. In such electrodes, it is not difficult to align the front end by bending the electrode wire so that it is dispensed at an optimum position. Since the front end of the electrode is generally in a zone of elevated temperature such as 1400° C., such metallic electrodes often have only a short life, particularly in a hostile environment such as the flames of sulphurous oils.

These dangers apply even more so to electrodes intended to monitor ionisation because such electrodes are generally even closer to the hottest parts of the flame.

The invention is based on the problem of providing an electrode arrangement of the aforementioned kind which, whilst retaining good adjustment possibilities, facilitate a longer life for the electrode.

This problem is solved according to the invention in that the electrode is of ceramic material such as silicon carbide and the holder can be turned with respect to the supporting plate and locked thereto.

By using a ceramic rod as the electrode, one achieves a practically unlimited life for oil as well as gas. The ceramic material has a high stability in relation to high temperatures as well as chemical reactions. Ceramic electrodes therefore have a high shape-retaining stability and are not decomposed even in sulphurous oil flames. However, ceramic electrodes cannot be deformed after manufacture. It is therefore not possible to adjust them by bending. However, the rotatability of the holder permits a very accurate adjustment to be made. There is no difficulty in arranging the front end of the electrode at a particular spacing from the burner axis and thereby achieving the optimum position. For example, in the case of an ionisation monitoring electrode, the front end can be arranged in the reaction zone of the flame to produce the largest signal.

By reason of the rotatability, it is even possible to use a straight ceramic rod as electrode and yet bring its front end near the burner axis, preferably into the reaction zone of the flame.

In a preferred embodiment, the holder has a spherical section pressed by retaining means into a hole in the supporting plate of smaller diameter then the spherical section. The hole and spherical section form a ball joint to permit pivotability in all radial planes. In addition, the hole is fairly well sealed from the air by the biassed spherical section. In a dividing wall, one thereby avoids the passage of a disruptive air stream through the hole that might detrimentally influence an optimum air distribution and could also give rise to carbon deposits on the electrode. Manufacture of the supporting plate is very simple because only the hole need be provided.

Advantagesously, the retaining means are a wire spring comprising a coil for abutting the spherical section at the side remote from the supporting plate and a laterally extending loop for securing to the supporting plate. The coil will normally be prestressed so that the spherical section is pressed into the hole of the supporting plate.

If the loop is connected to the side of the coil remote from the supporting plate, the prestressing transmitted to the coil by the loop will be fully effective through the entire coil.

In the simplest case, the loop is secured to the supporting plate by a screw. The coil is prestressed by tightening the screw.

In a further embodiment, the electrode is axially displaceable in a cylindrical bore of the holder and can be locked thereto. The front end of the electrode can thereby be arranged at any point within a comparatively large frustum of a cone. The axial displaceability in conjunction with the angular mobility enables a single type to be adapted to different nozzles, operating pressures, combustion chamber constructions, flame sizes and shapes etc.

In a very simple construction, the holder has a cross-slit which intersects the bore and in which an arm of a hair pin spring is engaged. The arm which resiliently lies on the electrode is fully adequate to secure it in the axial direction.

The connection at the rear end of the ceramic rod can be simply effected by a round plug.

The invention will now be described in more detail with reference to a preferred example illustrated in the drawing, wherein.

Figure 1:
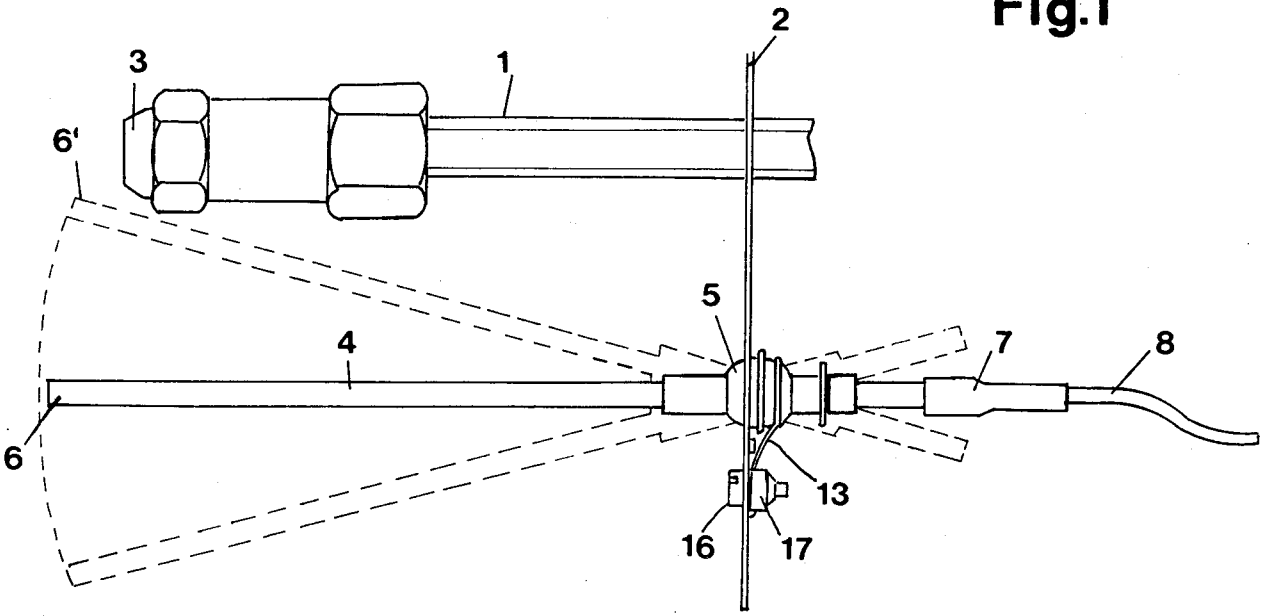
FIG. 1 is a side elevation of the electrode arrangement according to the invention.

FIG. 1 shows a nozzle rod 1 which passes through a sealing supporting plate 2 and carries a nozzle 3 at the front end. Held in the same supporting plate 2 by means of a holder 5, there is an electrode 4 in the form of a ceramic rod of silicon carbide. The front end 6 of this electrode rod can, as indicated in broken lines, be moved so that the end can also assume the position 6' in the vicinity of the nozzle 3. To bring about the electrical connection, a round plug 7 with connecting cable 8 is placed over the rear end of the electrode rod 4.

Figure 2:
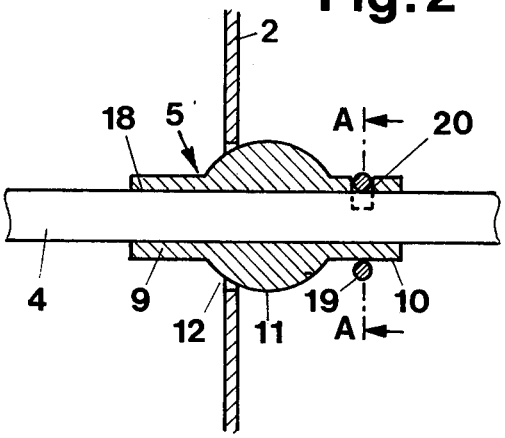
FIG. 2 is a longitudinal section through the holder (without coil spring)
Figure 3:
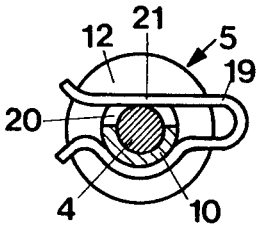
FIG. 3 is a cross-section through the holder taken on the line A-A in FIG. 2.
Figure 4:
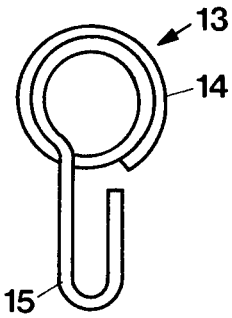
FIG. 4 is a plan view of the coil spring.
Figure 5:
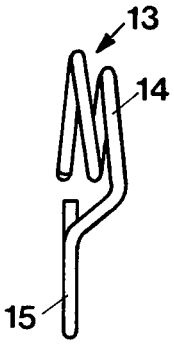
FIG. 5 is a side elevation of the coil spring.

The holder 5 is of insulating material and, as shown in FIG. 2, between two cylindrical sections 9 and 10 it has a spherical section 11 which is pressed into a circular hole 12 of the supporting plate 2 of smaller diameter than the spherical section 11 so that an adequate seal is produced against air. Pressure is provided by retaining means 13 formed by a wire spring which consists of a coil 14 and a laterally-extending loop 15. The loop 15 is connected to the end of the coil 14 remote from the supporting plate 2. The loop is secured to the supporting plate 2 by means of a screw 16 and a nut 17 in the form of a clamp (see FIG. 1). This stresses the wire spring and produces a sufficient force for pressing the spherical section 11 into the hole 12. At the same time, the holder 5 and thus the electrode 4 is locked in the desired angular position. The electrode rod 4 is axially displaceable in a bore 18 of the holder 5 but is locked by a hair pin spring 19. For this purpose, a transverse slit 20 is provided in the rear cylindrical section 10, an arm 21 of the hair pin spring 19 being engaged in the slit. This arm lies on the electrode rod 4 under prestressing and frictionally prevents undesired axial displacement.

It will be seen from this that an adjustment of the front end 6 of the electrode can be brought about at a desired point within a frustum of a cone of which the outlines are shown in broken lines in FIG. 1.

The electrode 4 can be used as an ignition electrode and in particular for ionisation monitoring.

The pivot angle the electrode preferably amounts to up to ±30°.

In a modification of the illustrated embodiment, the burner 1 may also be disposed further to the right (in FIG. 1) and even on the right-hand side of the supporting plate 2 on the same axis as is illustrated. If it is disposed to the right of the supporting plate 2, the latter is (likewise) provided with a hole, in the immediate vicinity of which the nozzle 3 is disposed, possibly somewhat within the hole, so that the flame jumps through this hole, is disposed substantially further to the left of the supporting plate 2, and the front end 6 of the electrode rod 4 can extend further into the reaction zone of the flame that is generally disposed in the marginal zone of the flame, regardless of whether it serves for ignition or flame monitoring.

Whereas the illustrated supporting plate 2 is of metal and the holder 5 of electrically insulating heat-resistant material, it is also possible to make the supporting plate 2 of electrically insulating heat-resistant material, preferably of armoured glass. In some cases, the holder 5 need not be electrically insulating.

We claim:

1. An electrode arrangement in an oil or gas burner, comprising a support plate, having a hole, a nozzle unit having a nozzle for directing fuel to burned to a region adjacent to said plate, an electrode rod holder having cylindrical end portions and a spherical intermediate portion, one of said cylindrical end portions extending through said hole in said support plate and the spherical portion being of larger diameter than said hold in said support plate, said holder having a bore extending therethrough, and an electrode rod extending through said bore, and having a front end forwardly of the support plate an holder, and a rear end rearwardly of the support plate and holder, and spring means mounted on said support plate for pressing said spherical portion into said hole and retaining the holder in selected adjusted pivoted positions.

2. An electrode arrangement in an oil or gas burner according to claim 1 wherein said spring means includes a spring having a coil portion abutting against said spherical portion on the side thereof remote from said support plate.

3. An electrode arrangement according to claim 1 wherein said spring means comprising a spring having a coil portion abutting against said spherical portion on the side thereof remote from said support plate and a laterally extending loop portion secured to said support plate.

4. An electrode arrangement in an oil or gas burner according to claim 3 wherein said spring loop portion is connected to said spring coil portion on the side thereof remote from said support plate.

5. An electrode arrangement in an oil or gas burner according to claim 1 wherein said electrode rod is axially displaceable in said bore in said holder and can be secured in any desired position therein.

6. An oil or gas burner according to claim 5 wherein the other of said cylindrical portions includes a cross slit which intersects said bore, and a spring clip having a first arm in said slit in resilient biasing engagement with said electrode and a second arm in resilient biasing engagement with said other cylindrical end portion on the opposite side thereof relative to said slit.

* * * * *